US006976675B2

(12) United States Patent
Gosslinghoff

(10) Patent No.: US 6,976,675 B2
(45) Date of Patent: Dec. 20, 2005

(54) METHOD AND INSTALLATION FOR TRANSFORMING A STREAM OF FLAT ARTICLES CONVEYED IN A HELD MANNER INTO A IMBRICATED STREAM IN WHICH THE ARRANGEMENT OF THE ARTICLES IS SELECTABLE

(75) Inventor: Reinhard Gosslinghoff, Wetzikon (CH)

(73) Assignee: Ferag AG, Hinwil (CH)

( * ) Notice: Subject to any disclaimer, the term of this patent is extended or adjusted under 35 U.S.C. 154(b) by 158 days.

(21) Appl. No.: 10/375,618

(22) Filed: Feb. 27, 2003

(65) Prior Publication Data

US 2003/0164588 A1 Sep. 4, 2003

(30) Foreign Application Priority Data

Mar. 1, 2002 (CH) ..... 0362/02

(51) Int. Cl.[7] ..... B65H 5/00

(52) U.S. Cl. ..... 271/264; 271/69; 271/184; 271/186; 271/204

(58) Field of Search ..... 271/264, 69, 184, 271/186, 198, 204

(56) References Cited

U.S. PATENT DOCUMENTS 4,604,851 A * 8/1986 Reist ..... 53/430
4,606,173 A * 8/1986 Meier ..... 53/430
5,931,459 A * 8/1999 Landgren ..... 271/204
6,139,252 A 10/2000 Honegger
6,619,651 B2 * 9/2003 Mader ..... 271/82
2001/0048190 A1 12/2001 Studer
2002/0171195 A1 * 11/2002 Lehmann ..... 271/186
2003/0218297 A1 * 11/2003 Honegger ..... 271/204

FOREIGN PATENT DOCUMENTS

EP 1 157 953 A1 5/2001

OTHER PUBLICATIONS

WO 02/14194 A1, Method and Arrangement for the Production of Crossed Stacks, Publication Date: Feb. 21, 2002.

* cited by examiner

*Primary Examiner*—David H. Bollinger

(57) ABSTRACT

A supply stream (1) of flat articles (8), in particular of printed products that are conveyed hanging and held by grippers, is transformed into an imbricated stream (2, 3, 4, 5) or into sections of an imbricated stream, in which the articles are arranged in one of two or advantageously four possible ways. For the stream transformation, the articles (8) are selectively deposited on a conveying surface at a first or at a second depositing point (I, II). The articles (8) deposited at the first depositing point (I) or to be deposited at the first depositing point (I) are additionally rotated by 180° (after or before deposition) and the held article edges are, advantageously selectively, leading or trailing on deposition. The selective stream transformation and switching between transformation modes (A, B/B', C or D/D') are very simple. The stream transformation is suitable for supplying an imbricated stream of printed products selectively to either one of two stacking devices with opposing stacking directions, and for producing cross stacks (6, 7) in the stacking devices.

8 Claims, 5 Drawing Sheets

METHOD AND INSTALLATION FOR TRANSFORMING A STREAM OF FLAT ARTICLES CONVEYED IN A HELD MANNER INTO A IMBRICATED STREAM IN WHICH THE ARRANGEMENT OF THE ARTICLES IS SELECTABLE

BACKGROUND OF THE INVENTION

Field of the Invention

The invention relates to piece goods conveyance and more particularly concerns a method and an installation for transforming a stream of flat articles conveyed in a held manner (in particular, printed products, such as newspapers, periodicals or brochures) into an imbricated stream, wherein the relative arrangement of the articles is freely selectable.

In particular, in dispatch room technology, it is known to transport printed products (such as newspapers, periodicals, brochures or intermediate products for printed products) one behind the other, wherein each one of the printed products is held in an edge zone by a gripper and the held edges are aligned substantially transverse to the conveying direction (gripper stream), or wherein the printed products are lying loosely on a conveying surface, usually overlapping one another (imbricated stream). Gripper streams, as well as imbricated streams, are dense conveying streams, in which the distances between the printed products (gripper spacing or scale spacing) are substantially smaller than the flat extension of the printed products, so that high conveying performance capacities can be achieved with relatively low transportation speeds.

In gripper streams, the printed products, or at least their held edges, are accurately positioned and the articles are relatively well accessible. Conveyance with many different spatial article orientations is possible. Corresponding conveying devices are relatively simple, as long as the distances between products or grippers respectively are constant (e.g., a circulating conveying organ with grippers arranged on it). Gripper streams are particularly suitable for conveyance along conveying tracks with a complicated routing and for processing the printed products during conveyance.

In imbricated streams consisting of loosely lying products, on the one hand, the printed articles are easily displaced relative to one another, but on the other hand, it is equally easy to realign them and it is equally easy to selectively and locally change their distances, as long as demands regarding distance accuracy are not too high. If conveyance is other than substantially horizontal, corresponding holding means (e.g., lateral clamping elements or pairs of conveyor belts) have to be provided. A disadvantage of loosely lying imbricated streams is that accessibility to the printed products is restricted. A further disadvantage is that devices for further processing or conveyance of the products usually impose tight conditions regarding the relative arrangement of the products that are supplied to them.

Usually, printed products are rectangular and frequently have a distinct longer edge (back edge, first or second fold) and a distinct shorter edge (first fold) or a distinct side (front side) respectively. In an imbricated stream, in which the longer edges of the printed products are aligned transverse and the shorter edges are aligned parallel to the conveying direction and in which the distinct edges and sides of all products are arranged in the same manner, there are eight ways in which the products can be arranged:

- distinct longer edge leading and lying on the upper side of the stream; front side facing either upwards or downwards (or distinct shorter side either on the left or on the right);

- distinct longer edge leading and lying on the lower side of the stream; front side facing either upwards or downwards (or distinct shorter side either on the left or on the right);
- distinct longer edge trailing and lying on the upper side of the stream; front side facing either upwards or downwards (or distinct shorter side either on the right or on the left);
- distinct longer edge trailing and lying on the lower side of the stream; front side facing either upwards or downwards (or distinct shorter side either on the right or on the left).

In imbricated streams formed by producing devices (e.g., rotary printing machine), all the printed products usually have the same orientation (e.g., longer folded edge leading and arranged on the upper side of the stream, front side facing upwards). In contrast to this, devices, to which imbricated streams are supplied, may demand diverse other product orientations and even product orientations, which vary over time. Thus, for example, product stacking is only possible if the trailing product edges in the imbricated stream supplied to the stacking arrangement are facing towards the stack to be formed. This means that for a stacking shaft to be supplied from laterally above, the supplied imbricated stream needs trailing product edges arranged on its bottom side. For cross stacking in the same stacking shaft, the supplied imbricated stream needs to comprise alternating sections in which the distinct longer product edges are either leading (top side of the stream) or trailing (bottom side of the stream) and the distinct sides of all the supplied products need to face either upwards or downwards (or: distinct shorter edges in alternating sections on the left and on the right).

For the reasons described above, it is often necessary to provide a stream transforming means upstream of a device for processing products supplied in an imbricated stream. This stream transforming means serves for establishing a product arrangement within the imbricated stream, which is suitable for the device following downstream. If several devices processing imbricated streams have to be supplied by the same imbricated stream, or if demands regarding stream transformation change from time to time, the transforming means needs to be equipped for a plurality of different transformation modes and it has to be capable of being switched-over from one transformation mode to another.

Stream transforming means comprising two transformation modes are described in the publications EP-1157953(or US-2001 0048190), US-6139252, WO-02/14194 or EP-1277685.

SUMMARY OF THE INVENTION

It is the object of the invention to create a method and an installation for stream transformation, wherein flat articles are supplied in a gripper stream (articles arranged one behind the other, individually held at one edge, the held edges being oriented substantially transverse to the conveying direction) and wherein the gripper stream is selectively transformed into an imbricated stream with one of at least two, preferably of four selectable article arrangements in such a manner that it is possible to process the imbricated stream to form cross stacks or stacks in a stacking device or in one of two stacking devices with opposite stacking directions. The method and the installation in accordance with the invention are particularly simple and allow simple switching from one transformation mode to another one.

According to the invention, the flat articles are conveyed through first and second depositing points while being held at upper edges oriented substantially transverse to the conveying direction. Through selective de-activation of the grippers, the flat articles are released selectively either at the first depositing point or at the second depositing point so as to be deposited in the form of an imbricated stream (two transformation modes). The articles deposited at the first depositing point are rotated by 180° around the stream axis following deposition (i.e. in the imbricated stream) or prior to deposition (i.e. in the gripper stream) respectively. Prior to de-activation of the grippers, the lower, not held edges of the supplied articles are retarded or accelerated relative to the upper, held edges. For achieving four transformation modes, this positioning of the lower edges is selectable, so that the edges being the held edges in the gripper stream become selectively either the leading edges or the trailing edges in the imbricated stream (in both cases lying on top of the stream). Between the supply and the deposition of the articles, it is, of course, possible to provide means for changing the conveying direction and/or further rotating the articles.

The installation in accordance with the invention comprises a supply means with grippers and a conveying-away means with a conveying surface. At least at the first and at the second depositing points, the supply means and the conveying away means are arranged in such a manner that the grippers and the conveying surface move in the same direction and the grippers are arranged above the conveying surface. For rotating the articles deposited at the first depositing point, a means for rotating the imbricated stream (for example, a twisted pair of conveyor belts) or a means for rotating the gripper stream (for example, supply means or auxiliary conveying means with grippers and with a twisted conveying track or grippers capable of being swiveled or rotated in a plane perpendicular to the conveying direction) are provided.

BRIEF DESCRIPTION OF THE DRAWINGS

The method according to the invention and exemplary embodiments of the installation in accordance with the invention are described in more detail on the basis of the following Figures, wherein.

DETAILED DESCRIPTION OF THE PREFERRED EMBODIMENTS

Figure 1:
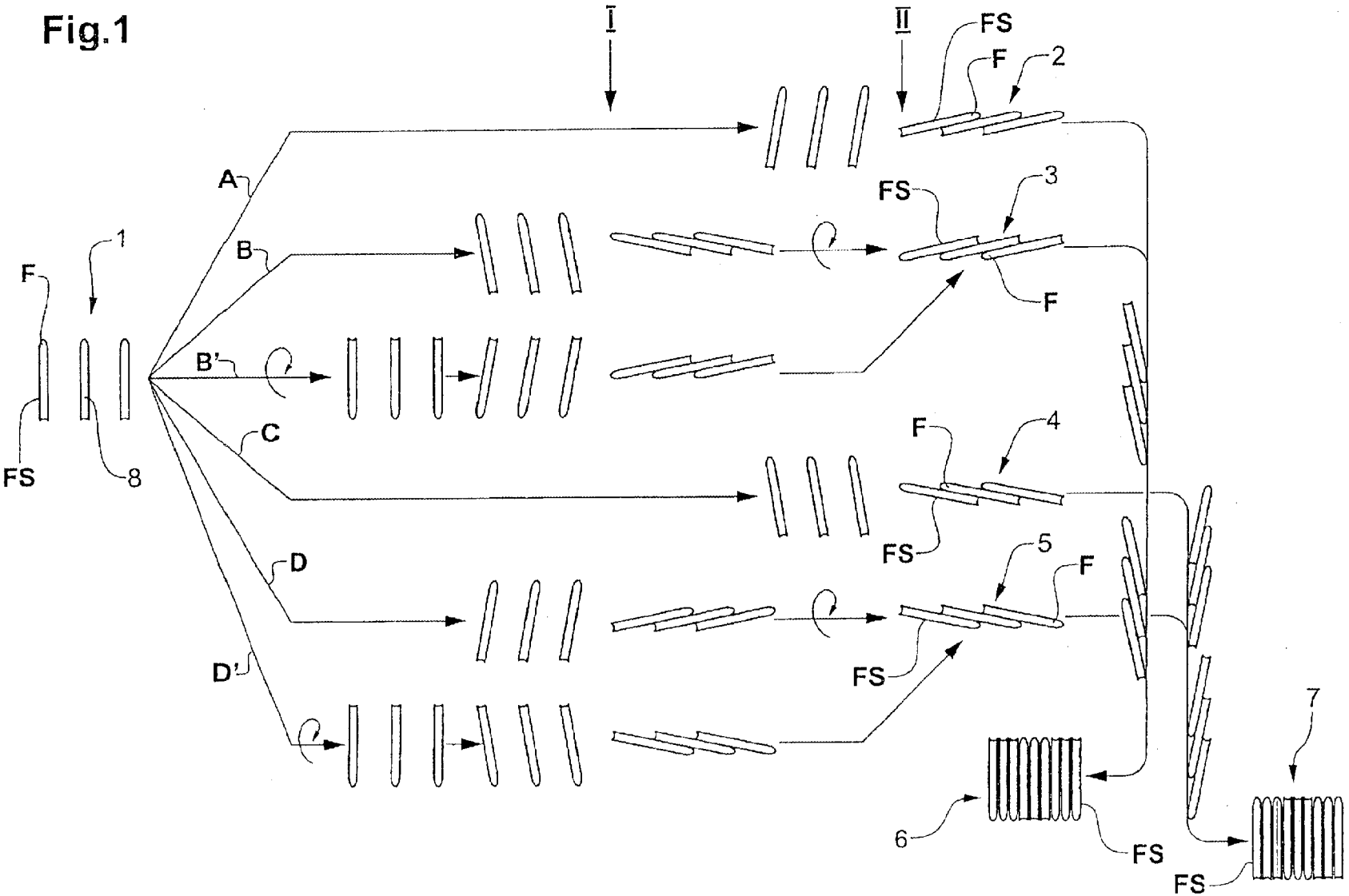
FIG. 1 shows a schematic diagram of the method in accordance with the invention.

FIG. 1 is a schematic diagram of the method according to the invention, which method serves for selectively transforming a supplied stream 1 (gripper stream) into any one of four imbricated streams 2, 3, 4 and 5, which may be used for selectively producing stacks 6 and 7 in opposing stacking directions, wherein the produced stacks are either cross stacks or stacks with uniformly aligned articles.

The flat articles 8 illustrated in FIG. 1 are e.g. folded or bound printed products, the one longer edge F of which is distinct by the fold or the back and the one side of which is distinct by being the front side FS. These printed products are shown in the schematic diagram viewed perpendicular to the conveying direction (arrows) and substantially parallel to the distinct edges F.

In the illustrated supply stream 1, the printed products 8 are held at their fold edges F and these fold edges are directed upwards. The front sides are facing backwards. It goes without saying, that the method in accordance with the invention can be carried out in exactly the same manner, if the distinct edges and sides of the printed products in the supplied gripper stream are arranged in a manner different from the one illustrated. In the four different imbricated streams 2, 3, 4 or 5; which can be made from the supply stream 1 as illustrated, the articles are arranged as follows:

In the imbricated stream 2, the fold edges F are leading and lying on the upper side of the stream, the front sides FS are facing upwards. For producing the imbricated stream 2, the printed products are deposited with leading fold edges F at the second depositing point II (transformation mode A).

In the imbricated stream 3, the fold edges are trailing and lying on the bottom side of the stream, the front sides FS are facing upwards. For producing the imbricated stream 3, the printed products are deposited with the fold edges F trailing and facing upwards at the first depositing point I and the deposited imbricated stream is rotated around its own axis (transformation mode B) or the supplied gripper stream or a further gripper stream produced by transfer to an auxiliary conveying means is rotated around its own axis and the printed products are deposited with their fold edges F trailing and facing downward at the first depositing point I (transformation mode B').

In the imbricated stream 4, the fold edges are trailing and lying on the upper side of the stream, the front sides FS are facing downwards. For producing the imbricated stream 4, the printed products are deposited with trailing fold edges at the second depositing point II (transformation mode C).

In the imbricated stream 5, the fold edges F are trailing and lying on the upper side of the stream, the front sides are facing downwards. For producing the imbricated stream 5, the printed products are deposited with their fold edges F leading and facing upwards at the first depositing point I and the imbricated stream is rotated around its own axis (transformation mode D) or the supplied gripper stream or a further gripper stream produced by transfer to an auxiliary conveying means is rotated around its own axis and then the printed products are deposited with their fold edges F leading and facing downwards at the first depositing point I (transformation mode D').

For stacking, the imbricated streams 2 and 3 or imbricated stream sections, in which the products are arranged as in streams 2 and 3, respectively, are turned by 90° and are then stacked with a stacking direction substantially opposing the conveying direction during stream transformation. In such produced stacks 6, the front sides FS of the products are facing backwards relative to the stacking direction, independent of whether the stacks are cross stacks or not. For stacking, the imbricated streams 4 and 5 or imbricated stream sections, in which the products are arranged as in streams 4 and 5, are turned by 90° and are stacked in a stacking direction substantially the same as the conveying direction during stream transformation. In such produced stacks 7, the front sides FS of the products are facing backwards relative to the stacking direction, independent of whether the stacks are cross stacks or not. Therefore, stacks 6 and 7 viewed in stacking direction are the same with respect to the orientation of the printed products.

For producing cross stacks 6, the stream transformation installation is periodically switched from transformation mode A to transformation mode B or B' and vice-versa, i.e., the products are deposited alternately at the first depositing point I or at the second depositing point II, wherein the depositing points are not switched or are designed for one only deposition mode. The same applies for the production of cross stacks 7 (switch-over from transformation mode C to transformation mode D or D' and vice-versa). When changing from producing stacks 6 to producing stacks 7 (switch-over from transformation modes A and B or B' to transformation modes C and D or D' and vice-versa), the depositing points I and II are switched from deposition with leading held edges to deposition with trailing held edges and vice-versa. Switching between different transformation modes is obviously a very simple matter.

FIG. 1 makes it obvious that the imbricated formations 2 to 5 can be subjected to further changes of the conveying direction or to further rotation between supply and deposition and therefore may be oriented in a different way than the way shown in FIG. 1 and described in the above paragraphs. However, the simple way in which one of the two or four transformation modes can be selected is not changed by such further direction changes or rotations.

Figure 2:
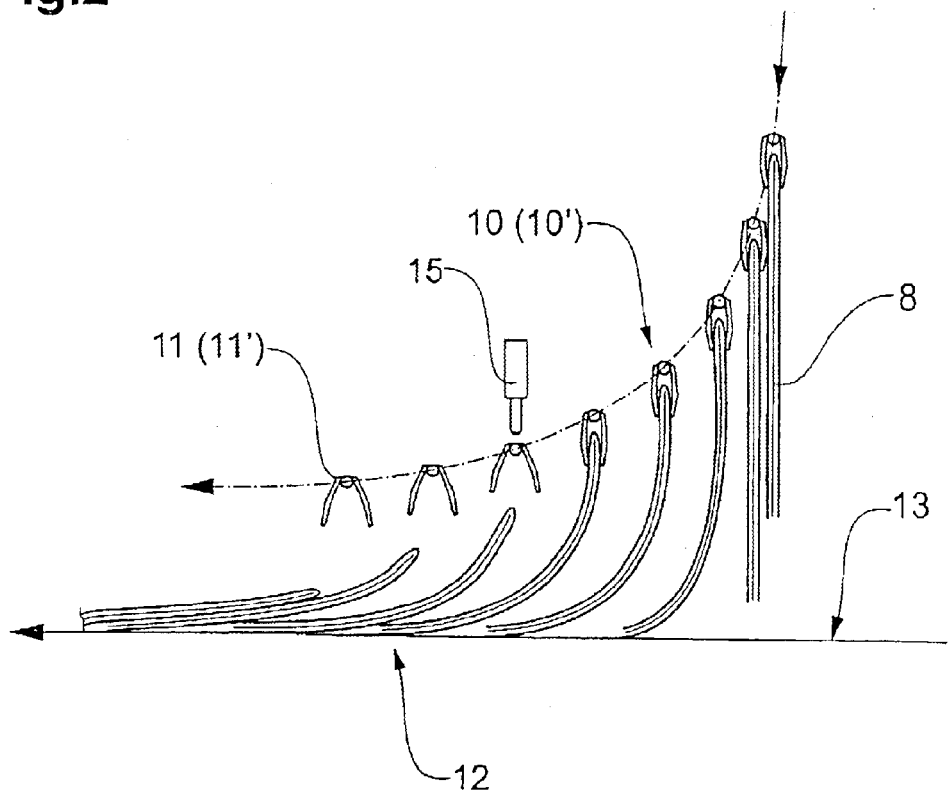
FIGS. 2 and 3 show a preferred embodiment of a depositing point for a selectable article deposition being applicable in the installation according to the invention and being set-up for deposition with trailing, held edges (FIG. 2) and being set-up for deposition with leading, held edges (FIG. 3)
Figure 3:
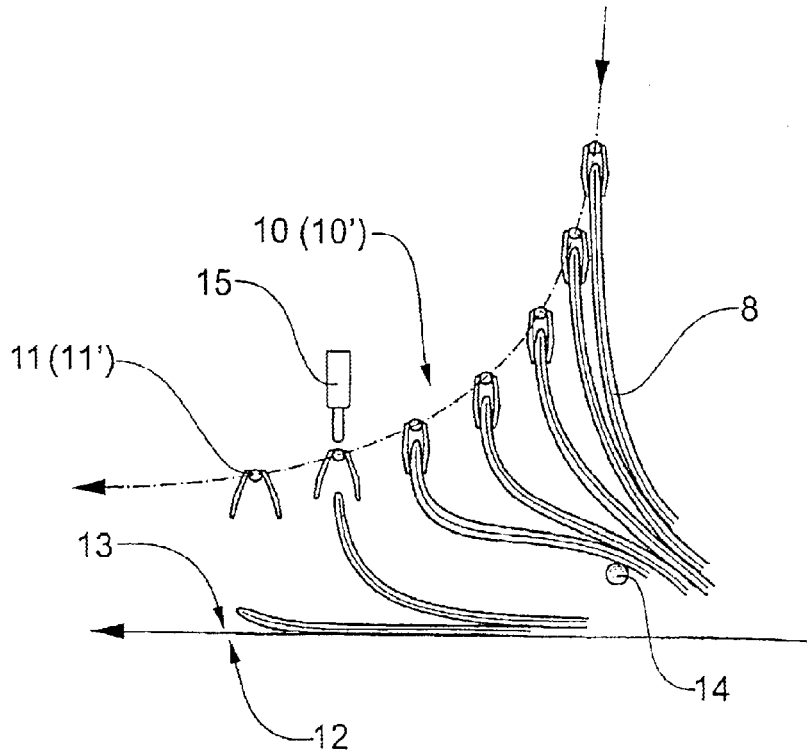

FIGS. 2 and 3 schematically illustrate an advantageous embodiment of a depositing point. This may be the first depositing point I independent of whether depositing takes place before or after rotation (transformation modes B, D, B', D'), or it may be the second depositing point II (transformation modes A and C). FIG. 2 shows the depositing point set-up for deposition with trailing held edges, FIG. 3 for deposition with leading held edges. The supply means 10 or auxiliary transportation means 10' with grippers 11 (or 11') and the conveying-away means 12 with a conveying surface 13 are illustrated very schematically. The grippers 11 and the conveying surface 13 are driven in the same direction and the grippers 11 move towards the conveying surface 13 from above. At the depositing point, there are deactivation means 15 for selectively de-activating the grippers 11, i.e. for bringing them into a configuration for releasing the held article, e.g. opening the grippers 11.

The speeds of the grippers 11 and of the conveying substrate 13 through the depositing point are advantageously about equal. The conveying surface 13 may move a little bit faster than the grippers 11, such that for flat articles or printed products 8 being supplied unhindered, the loose edges are accelerated relative to the held edges as soon as they come into contact with the conveying surface 13, thereby causing the articles to assume a slanting position and to be deposited with trailing held edges. If, upstream of the point at which the grippers 11 are opened, an obstruction 14 is inserted into the stream between the conveying surface 13 and the grippers 11, then the loose edges of the articles 8 are pulled over this obstruction 14 and are, therefore, retarded relative to the held edges, so that the articles 8 are deposited with leading held edges.

For switching the depositing point illustrated in FIGS. 2 and 3 from deposition with trailing held edges to deposition with leading held edges, the obstruction 14 has to be inserted into the gripper stream, this being the only necessary action. For reverse switching, the obstruction 14 is removed from the gripper stream.

Figure 4:
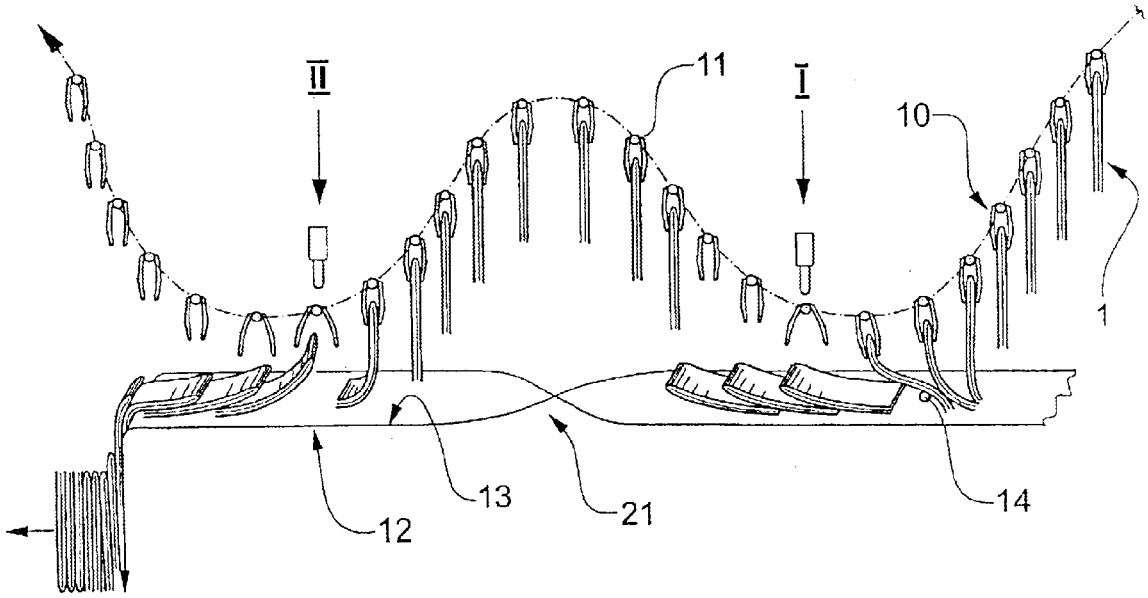
FIG. 4 shows an exemplary embodiment of the installation according to the invention comprising a twisted conveying surface for rotating the articles deposited at the first depositing point.

FIG. 4 shows in a very schematic manner an exemplary embodiment of a stream transformation installation in accordance with the invention. A supply stream 1 of flat articles is supplied to the installation by a supply means 10 comprising grippers 11, and is transformed into an imbricated stream with a selectable article arrangement, wherein the imbricated stream is conveyed onwards on a conveying surface 13. The transformation modes of the installation are transformation modes A, B, C and D. Mode C at the depositing point II and mode D at the depositing point I are illustrated. The conveying-away means 12 comprises a rotation zone 21 disposed between the first depositing point I and the second depositing point II. In this zone, the imbricated stream deposited at the first depositing point I is rotated around its own axis by 180°. The rotation zone 21 may be implemented in a known manner by a pair of conveyor belts (not depicted) that are twisted by 180°, such that the articles move from a lowermost one of the conveyor belts prior to the convolution to a lowermost one of the conveyor belts after the convolution.

For four transformation modes, the two depositing points I and II are designed and switchable as illustrated in FIGS. 2 and 3. The supply means 10 comprises a circulating conveying organ (only a part of it is illustrated) and grippers 11 arranged on it. The conveying organ is arranged in such a manner that, at the two depositing points I and II, the conveying organ runs in a direction beginning above the conveying surface 13 and extending downwardly toward the conveying surface 13 of the conveying-away means 12.

For the embodiment of the stream transformation installation illustrated in FIG. 4, it is advantageous, if, as illustrated, the first depositing point I is arranged upstream of the second depositing point II. If this is not the case, the stream of the rotated articles has to be transferred to the conveying surface 13 of the conveying-away means 12 at a switch point, which would render the installation significantly more complicated.

Figure 5:
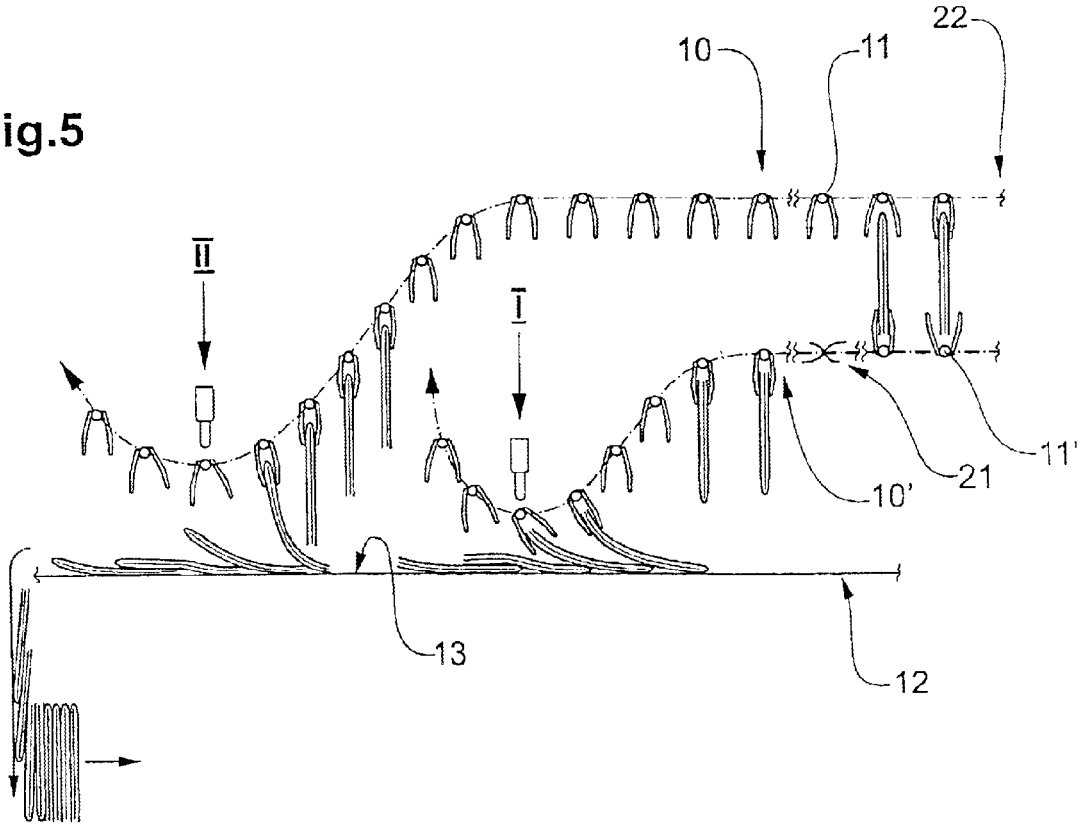
FIGS. 5 to 7 show three exemplary embodiments of the installation in accordance with the invention comprising a supply means or an auxiliary conveying means with grippers for rotating the articles deposited at the first depositing point.
Figure 6:
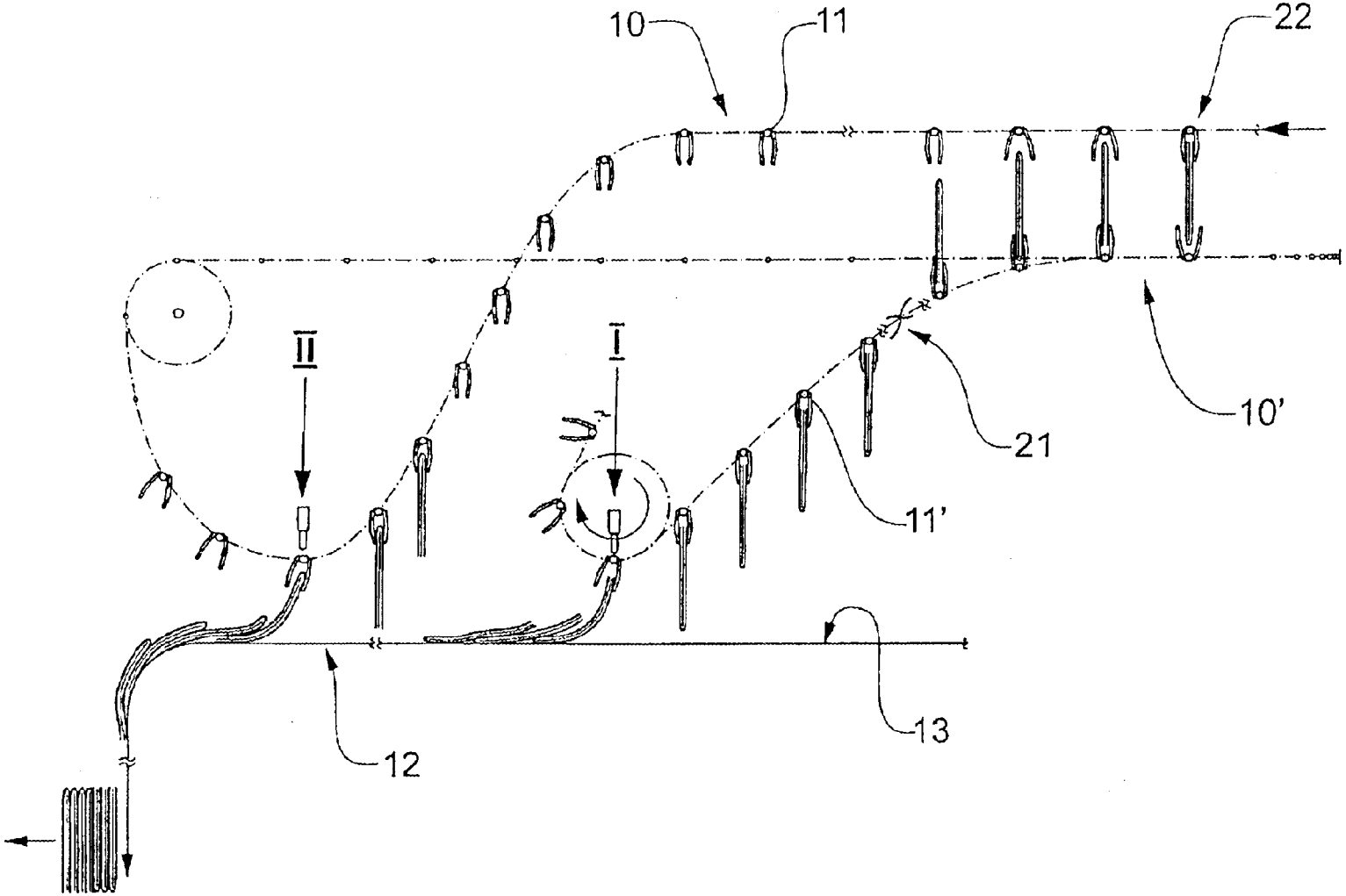
Figure 7:
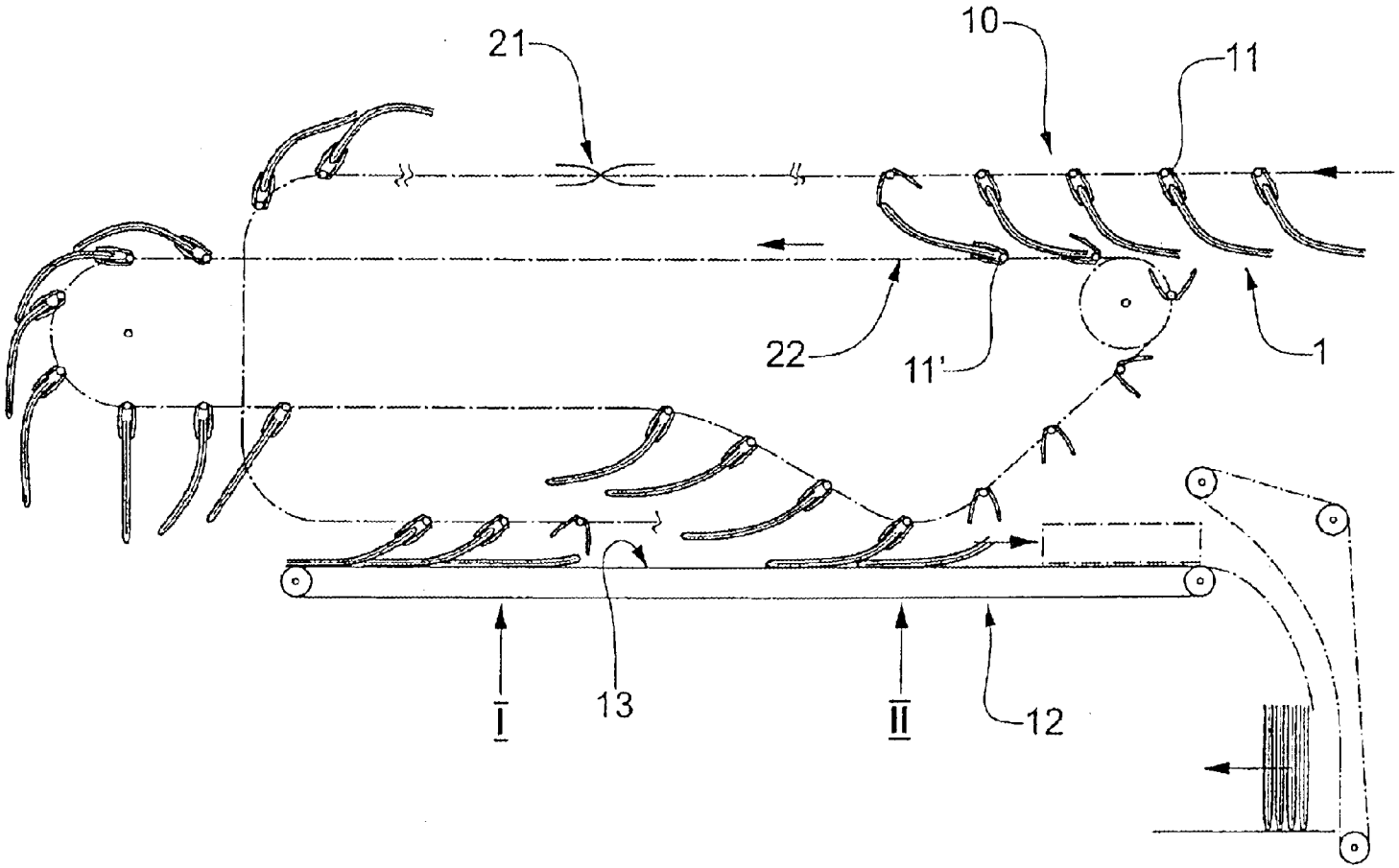

FIGS. 5 to 7 illustrate three further exemplary embodiments of the stream transformation installation according to the invention. These embodiments work with the transformation modes A, B', C and D'. FIGS. 5 and 7 show the modes A (II) and B' (I), FIG. 6 shows the modes C (II) and D' (I). The installations comprise an auxiliary conveying means 10'with further grippers 11', which, at a transfer point 22, take over the articles from the supply means 10 by gripping them at the edges opposite the held edges, thereby producing a further gripper stream. The further gripper stream (FIGS. 5 and 6) or the supplied gripper stream (FIG. 7) is rotated by 180° around its own axis in a rotation zone 21 and the articles of the further gripper stream are deposited at the first depositing point I, while the articles of the other gripper stream are deposited at the second deposition point II without rotation.

The installation in accordance with FIG. 5 comprises a separate auxiliary conveying means 10' comprising a circulating conveying organ (only a part of it is illustrated) with grippers 11'. The installation according to FIG. 6 comprises a supply means 10 looped in such a manner that a section of it that is not needed for the supply can take over the function of the auxiliary conveying means 10'. The auxiliary conveying means 10' according to FIG. 7 is either a separate conveying means or a section of the supply means 10.

The rotation of the stream of articles being transported by the supply means 10 or by the auxiliary conveying means 10' upstream of the first depositing point I (rotation zone 21) is implemented in a known manner by twisting the conveying organ by 180° or by swiveling or rotating the grippers 11' by 180° in a plane perpendicular to the conveying direction.

According to the embodiment illustrated in FIG. 7, the articles to be deposited in the first deposition point I are rotated without transfer, while the articles to be deposited at the second deposition point II are transferred to the grippers 11' of the auxiliary conveying means 10'. Both gripper streams are then directed into a conveying-away direction opposite to the supply direction and being the direction of the conveying away means 12, and are only then deposited.

It should be evident that the embodiments of the stream transformation installation of the present invention shown FIGS. 5 to 7 can be modified to have the first depositing point I disposed downstream of the second depositing point II, without rendering the installation more complicated.

What is claimed is:

1. An installation for transforming a supply stream (1) of flat articles (8) into an imbricated stream (2,3,4,5) with a selectable article arrangement, the installation comprising:

supply means (10) for supplying the flat articles (8) each held individually at an upper edge substantially transverse to a conveying direction, said supply means including grippers (11); and, conveying-away means (12) for conveying-away the imbricated stream (2, 3, 4, 5), said conveying-away means including a conveying surface (13);

wherein, at a first and a second depositing point (I, II), the conveying surface (13) is arranged underneath the grippers (11, 11') and is driven in the same direction as the grippers;

wherein at the first and the second depositing point (I, II), said installation includes means (15) for selectively de-activating the grippers (11, 11') and means for displacing the lower edges of the articles (8) held by the grippers (11, 11') into a leading or a trailing position relative to the held edges, and wherein, said installation includes means for rotating the articles by 180° around the conveying direction, said means for rotating either being located upstream of the first deposition point and equipped for rotating articles to be deposited at the first deposition point or being located downstream of the first deposition point and equipped for rotating articles deposited at the first deposition point.

2. The installation according to claim 1, wherein the displacing means are switchable so as to selectively displace the lower edges into one of a leading or a trailing position.

3. The installation according to claim 1, wherein the rotating means is arranged downstream of the first depositing point (I), said rotating means comprising an arrangement of convoluted conveyor belts.

4. The installation according to claim 1, wherein the rotating means is arranged upstream of the first depositing point (I) and the installation further comprises an auxiliary conveying means (10') with further grippers (11'), wherein the auxiliary conveying means (10') is designed and arranged such that it is capable of taking over the articles from the supply means (10) by gripping them at an edge situated opposite the edge held by the grippers (11) of the supply means (10) and wherein the auxiliary conveying means is capable of depositing the articles at the second deposition point (II) on the conveying surface (13) of the conveying-away means (12) or of rotating the articles by 180° and depositing them at the first depositing point (I) on the conveying surface (13) of the conveying-away means (12).

5. The installation according to claim 4, wherein, for the rotation, the supply means (10) or the auxiliary conveying means (10') comprises a convoluted conveying track or the grippers (11') are capable of being swiveled or rotated in a plane perpendicular to the conveying direction.

6. The installation according to claim 4, wherein the auxiliary conveying means (10') comprises a circulating conveying organ or that the supply means (10) comprises a looped routing such that a section of it is capable of taking over the function of the auxiliary conveying means (10').

7. The installation according to claim 1, wherein the means for selectively displacing the lower edges of the articles (8) supplied to the first or to the second depositing point (I, II) by the grippers (11, 11') is an obstruction (14) that is selectively introduced between the conveying surface (13) and the grippers (11,11').

8. Use of the installation according to claim 1, for selectively producing an imbricated stream or imbricated stream sections of flat articles to be supplied for stacking or cross stacking to a stacking device or selectively to one of two stacking devices with opposing stacking directions.

* * * * *

UNITED STATES PATENT AND TRADEMARK OFFICE

CERTIFICATE OF CORRECTION

PATENT NO. : 6,976,675 B2
DATED : December 20, 2005
INVENTOR(S) : Gosslinghoff

It is certified that error appears in the above-identified patent and that said Letters Patent is hereby corrected as shown below:

Title page,
Item [54], Title, delete "A" and insert -- AN --.

Signed and Sealed this

Twenty-eighth Day of March, 2006

JON W. DUDAS
*Director of the United States Patent and Trademark Office*